US006990840B2

(12) United States Patent
Park

(10) Patent No.: US 6,990,840 B2
(45) Date of Patent: Jan. 31, 2006

(54) CONJOINING APPARATUS USING ELECTROMAGNETIC FORMING

(75) Inventor: Shin Hee Park, Gunpo (KR)

(73) Assignee: Hyundai Motor Company, Seoul (KR)

( * ) Notice: Subject to any disclaimer, the term of this patent is extended or adjusted under 35 U.S.C. 154(b) by 23 days.

(21) Appl. No.: 10/751,039

(22) Filed: Dec. 31, 2003

(65) Prior Publication Data

US 2005/0097934 A1 May 12, 2005

(30) Foreign Application Priority Data

Nov. 10, 2003 (KR) ..... 10-2003-0079034

(51) Int. Cl.
*B23P 11/00* (2006.01)
*B21D 26/14* (2006.01)
*B60K 17/22* (2006.01)

(52) U.S. Cl. ..... 72/56; 29/419.2; 72/54; 72/430

(58) Field of Classification Search ..... 72/56, 72/54, 430; 29/419.2
See application file for complete search history.

(56) References Cited

U.S. PATENT DOCUMENTS

| | | | | |
|---|---|---|---|---|
| 3,345,732 | A * | 10/1967 | Brower | 72/56 |
| 3,992,773 | A * | 11/1976 | Duffner et al. | 72/56 |
| 5,442,846 | A * | 8/1995 | Snaper | 72/56 |
| 5,813,264 | A * | 9/1998 | Steingroever | 72/56 |
| 6,065,317 | A * | 5/2000 | Steingroever | 29/419.2 |
| 6,420,686 | B1 | 7/2002 | Benoit et al. | |
| 2003/0000638 | A1 | 1/2003 | Booske et al. | 156/272.2 |

FOREIGN PATENT DOCUMENTS

JP 2003-044150 6/2003

* cited by examiner

*Primary Examiner*—David B. Jones
(74) *Attorney, Agent, or Firm*—Morgan Lewis & Bockius LLP

(57) ABSTRACT

A conjoining apparatus using electromagnetic forming includes a field shaper for concentrating a magnetic field to a conjoining working object, a coil for generating and applying the magnetic field to the field shaper such that the field shaper can form a reactive force, and a charging circuit for supplying electricity to the coil. An auxiliary ring having higher conductivity than steel is disposed between the field shaper and the working object for generating an induced magnetic field.

2 Claims, 3 Drawing Sheets

CONJOINING APPARATUS USING ELECTROMAGNETIC FORMING

CROSS-REFERENCE TO RELATED APPLICATIONS

This application claims priority of Korean Application No. 10-2003-0079034, filed on Nov. 10, 2003.

FIELD OF THE INVENTION

Generally, the present invention relates to a conjoining apparatus using electromagnetic forming. More particularly, the present invention relates to a conjoining apparatus using electromagnetic forming wherein an auxiliary ring of aluminum or copper material is inserted between a field shaper and a working object to conjoin a working object that does not easily form an induced magnetic field.

BACKGROUND OF THE INVENTION

In connection with weight reduction of a vehicle, the use of aluminum material has become more prevalent, and accordingly, research has been undertaken regarding how to conjoin steel and aluminum materials. The two materials are difficult to conjoin together because of their material differences, and therefore a vehicle body is usually formed entirely of steel or of aluminum. To overcome this problem, generally by conjoining different materials such as steel and aluminum, electromagnetic forming has been proposed.

However, prior art conjoining schemes for steel and aluminum using electromagnetic forming of steel have only been applicable to the case in which an aluminum member is disposed exterior to a steel member. This is because a sufficient induced magnetic field is formed only at the aluminum. That is, the steel does not form a sufficient induced magnetic field, so the aluminum should be disposed exterior to the steel or the capability of a conjoining apparatus must be very high in order to enable conjoining of an exteriorly disposed steel member therewith.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

An exemplary conjoining apparatus using electromagnetic forming according to an embodiment of the present invention includes: a field shaper for concentrating a magnetic field to a conjoining working object; a coil for generating and applying the magnetic field to the field shaper such that the field shaper can form a reactive force; a charging circuit for supplying electricity to the coil; and an auxiliary ring disposed between the field shaper and the working object, for generating an induced magnetic field, the auxiliary ring having a conductivity greater than steel.

In a further embodiment, a pair of grooves are formed on an interior side of the auxiliary ring.

Embodiments of the present invention thus provide a conjoining apparatus using electromagnetic forming having non-limiting advantages of easy conjoining of work pieces by inserting an auxiliary ring of aluminum or copper material between a field shaper and the working object to conjoin the working object when it does not easily form an induced magnetic field.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
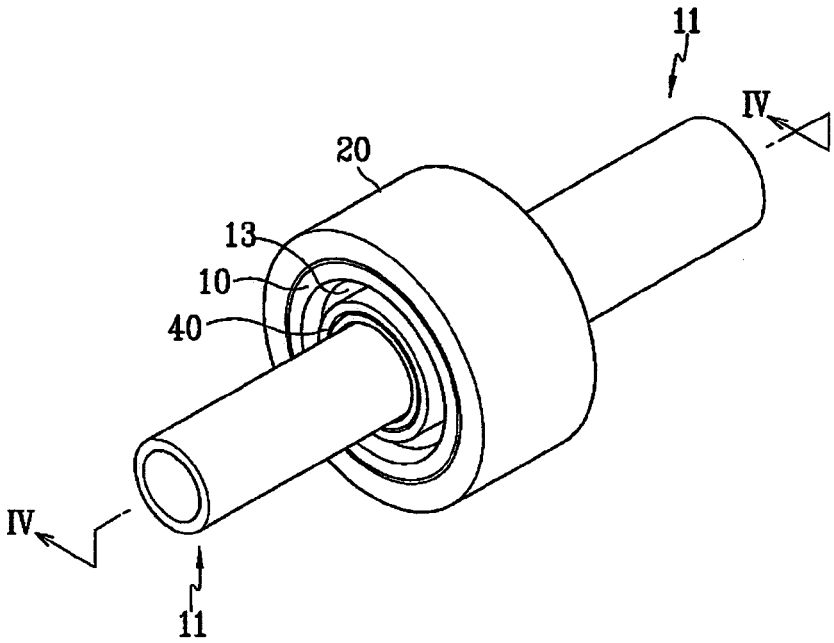
FIG. 1 is a perspective view of a conjoining apparatus using electromagnetic forming according to a preferred embodiment of the present invention.
Figure 2:
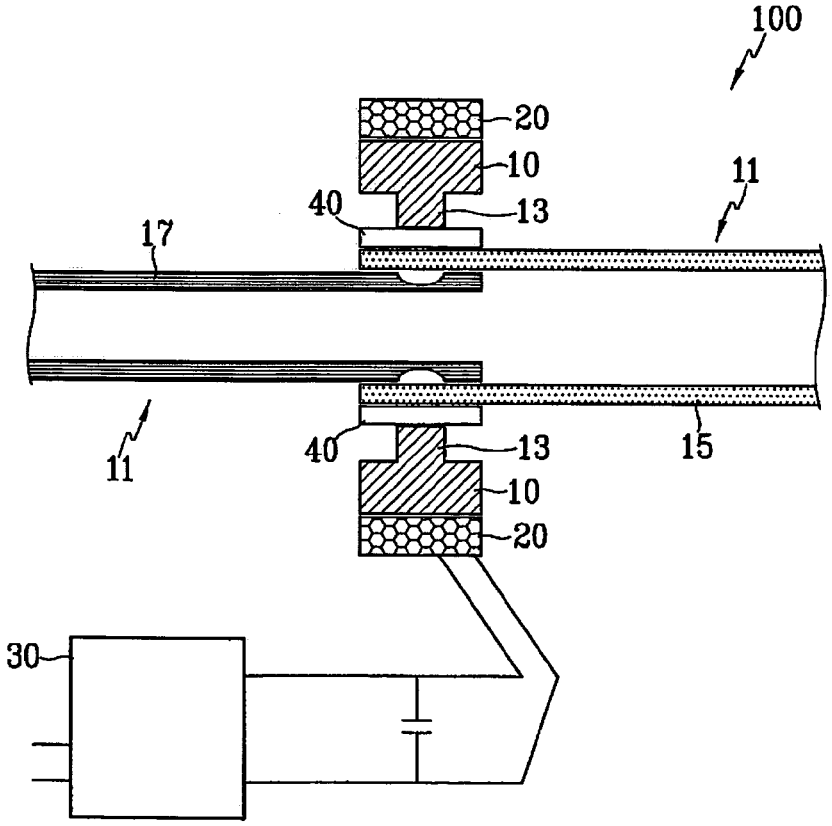
FIG. 2 is a sectional view of FIG. 1 along a line IV—IV.
Figure 3:
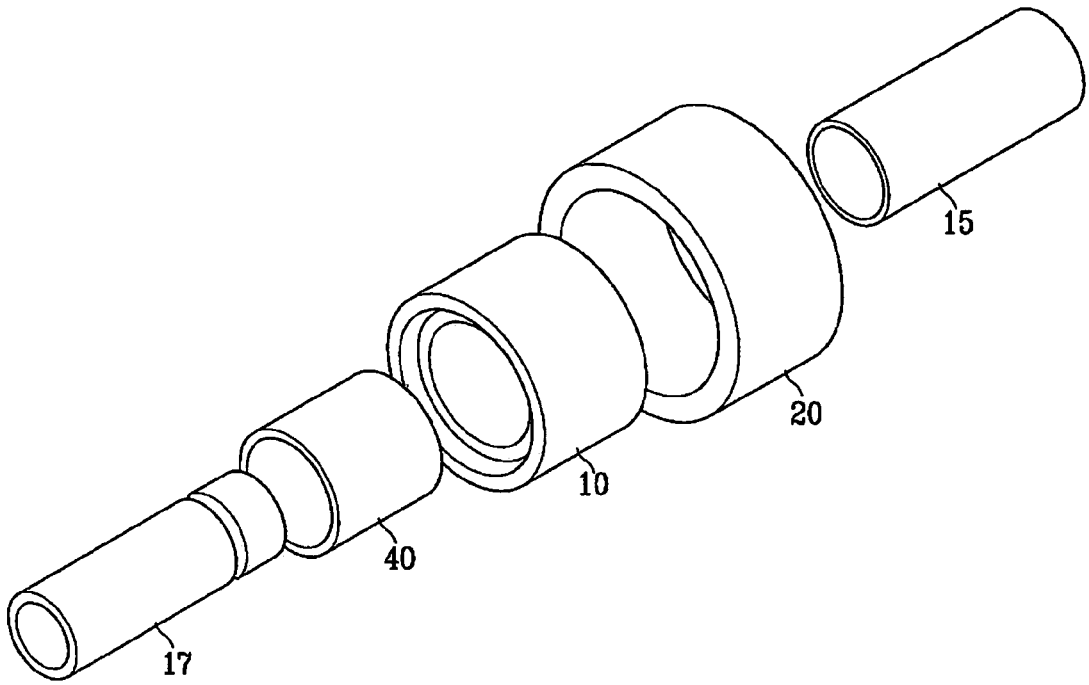
FIG. 3 is an exploded view of FIG. 1.

An embodiment of the present invention will hereinafter be described in detail with reference to the accompanying drawings.

The present invention is not limited to an embodiment described hereinafter, and may be realized in a variety of fashions. The present embodiment is only provided to fully describe the present invention and to fully convey the scope of the present invention to a person of ordinary skill in the art.

As shown in FIGS. 1–6, a conjoining apparatus 100 using electromagnetic forming according to an embodiment of the present invention is provided with a field shaper 10 for concentrating a magnetic field to a conjoining working object, a coil 20 for generating and applying the magnetic field to the field shaper 10 such that the field shaper 10 can form a reactive force, and a charging circuit 30 for supplying electricity to the coil 20. An auxiliary ring 40 is disposed between the field shaper 10 and the working object 11, for generating an induced magnetic field therebetween. The auxiliary ring 40 has conductivity greater than steel.

The field shaper 10 has a flange portion 13 projecting to the working object 11, and the magnetic field is concentrated at the flange portion 13 such that the forming load is strengthened. The coil 20 is wound at an exterior of the field shaper 10.

The coil 20 generates an instantaneous magnetic field and causes the field shaper 10 to apply a high pressure to the auxiliary ring 40 through the flange portion 13. The coil 20 is connected to the charging circuit 30 such that the coil 20 receives electricity therefrom. The charging circuit 30, having been charged with electric energy, instantaneously supplies the charged electricity to the coil 20 such that a great induced magnetic field is thereby generated.

Figure 6:
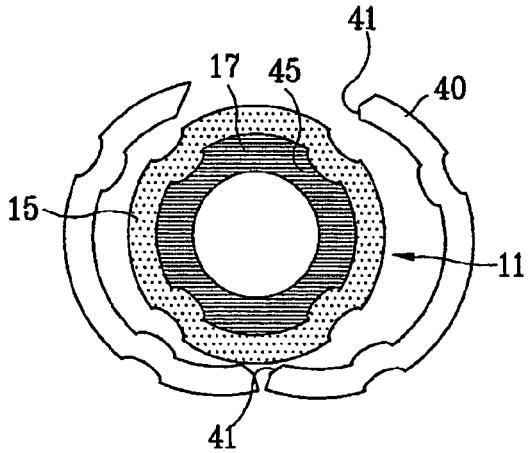

The auxiliary ring 40 is a member inserted between the conjoining working object 11 and the field shaper 10. The auxiliary ring 40 is made of a material that has higher conductivity than steel, such as aluminum or copper. As shown in FIG. 6, the auxiliary ring 40 has a pair of grooves 41 on an interior side thereof. The grooves 41 enable easy detachment of the auxiliary ring 40 from the working object 11 after conjoining, since a crack is formed at the grooves 41 by a pressure load on the auxiliary ring 40 during the conjoining.

An operation of the auxiliary ring 40 is as follows. When the working object 11 is made of a material having low conductivity such as steel, it is difficult to form a strong induced magnetic field therein. Therefore, it is difficult to apply a sufficient reactive force to the working object 11 by the field shaper 10. In this case, the auxiliary ring 40 made of aluminum or copper that has high conductivity may form a strong induced magnetic field therein and accordingly receive a strong reactive force from the field shaper 10 through its projected portion 13 such that the auxiliary ring 40 deforms to in turn apply the reactive force to the working object 11.

That is, in the case that a steel member 15 is to be conjoined exterior to an aluminum member 17, an induced magnetic field cannot be easily formed at the steel member 15, so the field shaper 10 cannot apply a strong reactive force to the steel member 15. Therefore, in this case, an auxiliary ring 40 made of aluminum or copper having high conductivity is disposed exterior to the work piece 11 such that it may form a strong induced magnetic field, and accordingly form a reactive force by an interaction with the field shaper 10.

Such an operation of the auxiliary ring 40 is explained in further detail with reference to FIGS. 4–6.

Figure 4:
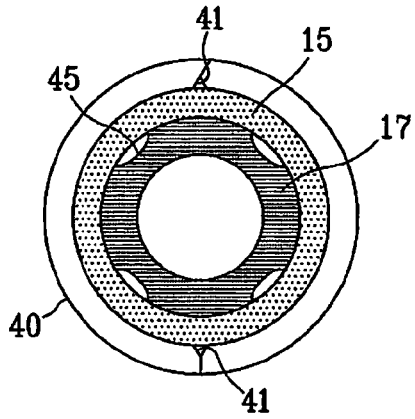
FIGS. 4–6 illustrate an electromagnetic forming process by use of an auxiliary ring according to an embodiment of the present invention.

Firstly, as shown in FIG. 4, the auxiliary ring 40 is inserted exterior to the working object 11, which includes the steel member 15 and aluminum member 17.

Figure 5:
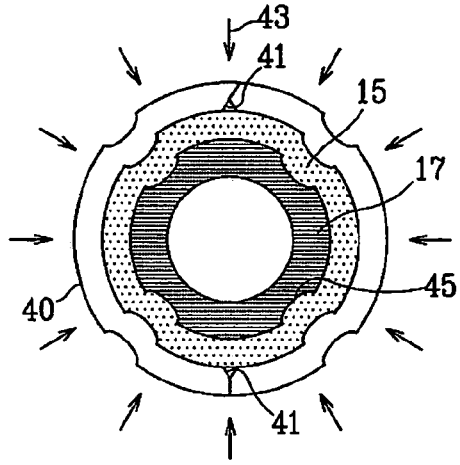

Subsequently as shown in FIG. 5, the auxiliary ring 40 receives a radial compression pressure 43 by an electromagnetic interaction with the field shaper 10 and the coil 20. Then, the auxiliary ring 40 subsides onto conjoining indentations 45 formed at either of the members 15 and 17 of the working object 11.

Subsequently as shown in FIG. 6, cracks are formed along the grooves 41 by the compression pressure 43, and the auxiliary ring 40 becomes easily detached from the conjoined working object by dividing it at the cracks.

As shown above, a conjoining apparatus using electromagnetic forming according to an embodiment of the present invention has the following effects.

A working object including steel that does not form a strong induced magnetic field may be easily electromagnetically formed by using an auxiliary ring, and the auxiliary ring may be easily detached from the conjoined working object. Therefore, in comparison with welding, this electromagnetic forming is sufficient for conjoining the working object and simplifies a process thereof.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A conjoining apparatus using electromagnetic forming, comprising:

a field shaper for concentrating a magnetic field to a conjoining working object;

a coil for generating and applying the magnetic field to the field shaper such that the field shaper can form a reactive force;

a charging circuit for supplying electricity to the coil; and an auxiliary ring disposed between the field shaper and the working object, for generating an induced magnetic field, the auxiliary ring having a conductivity greater than steel, wherein a pair of grooves are formed on an interior side of the auxiliary ring.

2. A conjoining apparatus using electromagnetic forming, comprising:

a field shaper for concentrating a magnetic field to a conjoining working object;

a coil for generating and applying the magnetic field to the field shaper such that the field shaper can form a reactive force;

a charging circuit for supplying electricity to the coil; and an auxiliary ring disposed between the field shaper and the working object, for generating an induced magnetic field, the auxiliary ring having a conductivity greater than steel, wherein the field shaper is ring-shaped with an inner projecting flange.

* * * * *